United States Patent [19]

Chow

[11] 4,114,31

[45] Sep. 19, 197

[54] TOY GUNS

[75] Inventor: Thomas Chow, Kowloon, Hong Kong

[73] Assignee: Arco Industries Ltd., Hong Kong

[21] Appl. No.: 782,363

[22] Filed: Mar. 29, 1977

[30] Foreign Application Priority Data

Aug. 27, 1976 [GB] United Kingdom..... 35778/76

[51] Int. Cl.[2] ..... A63H 5/00

[52] U.S. Cl. ..... 46/192; 46/1 E; 42/54

[58] Field of Search ..... 46/189, 192, 191, 1 E, 46/177, 174, 175 R; 42/54, 55, 57, 58

[56] References Cited

U.S. PATENT DOCUMENTS

| | | | |
|---|---|---|---|
| 1,619,184 | 3/1927 | Bregman | 46/192 |
| 2,925,685 | 2/1960 | Blankenship | 46/189 |
| 3,044,213 | 7/1962 | Licitis | 46/177 |
| 3,064,389 | 11/1962 | Lemelson | 46/192 |
| 3,073,060 | 1/1963 | Veris | 46/177 |
| 3,078,618 | 2/1963 | Hough et al. | 46/17 |
| 3,859,749 | 1/1975 | Morin et al. | 46/3 |

FOREIGN PATENT DOCUMENTS

| | | | |
|---|---|---|---|
| 1,027,110 | 5/1953 | France | 46/18 |

*Primary Examiner*—Louis G. Mancene
*Assistant Examiner*—Mickey Yu
*Attorney, Agent, or Firm*—C. Hercus Just

[57] ABSTRACT

A toy gun having a barrel and handle supporting pivoted trigger and spring-pressed hammer engageabl with an elongated slide having driving teeth engageabl with pinion drive means for a noise-producing unit i said barrel which includes a vibratable spring that pro duces a sound resembling a ricocheting bullet when sai slide is moved forwardly by said hammer after it i moved rearward by said trigger and released to permi the spring to move the hammer forwardly sharply.

7 Claims, 2 Drawing Figures

TOY GUNS

BACKGROUND OF THE INVENTION

This invention concerns improvements in or relating to toy guns of the kind incorporating means for producing sound imitating that of a ricocheting bullet.

Such guns are already known, it being appreciated that the improved realism imparted by the ricochet should increases the pleasure experienced by children when using such guns. Hitherto however, the sound-producing means employed have been complex and costly mechanisms involving, for instance, a sound recording of a ricochet in combination with sound-producing means. Furthermore, the sound-producing means have been sizable and have been required to be installed in say the butt of a rifle because of their size. In view of this, they have not been applicable to hand guns.

It is thus an aim of this invention to provide a toy gun with ricochet sound-producing means which can be compact, relatively inexpensive and incorporable in a hand gun.

SUMMARY OF THE INVENTION

According to the invention we provide a toy gun incorporating means for producing sound imitating that of a ricocheting bullet, said means comprising a flywheel arranged to be driven on actuation of the gun, such flywheel having or being associated with a cylindrical surface including a multiplicity of projections against which is resiliently urged a member adapted to be vibrated by the projections to produce said sound.

Thus, the flywheel can be arranged to be driven at high speed, and the vibrations thus imparted to the resiliently urged member produce the sound of a ricocheting bullet. Preferably some means for amplifying the sound is provided, and in one embodiment this may be effected by providing the member in the form of a spring which is urged also against a sound amplifying diaphragm. The spring may for example be mounted on a member of which the diaphragm forms part, such diaphragm preferably being open to the outside of the gun for efficient sound transmission.

The flywheel will preferably be arranged to be driven by geared cog means in order to enable a sufficiently high speed of rotation to be obtained. While an electric motor could if desired be employed to drive the flywheel, mechanical means are preferred in view of the relatively low expense and weight. A toothed slide member is preferably employed which can engage a toothed wheel to drive the cog means. The slide member can be resiliently urged in its driving direction either by a spring directly connected to it or under the action of a further resiliently urged member, for example, a pivotable hammer member.

When a slide member as aforesaid is incorporated, it may be manually set by the trigger of the gun ready for being urged in its driving direction and this may be the preferred arrangement when it is directly acted upon by a spring. Where a hammer member as aforesaid is employed however, there is preferably provided a further spring which serves to set the slide member.

In order that the invention may be readily understood, an embodiment thereof will now be described by way of example with reference to the accompanying drawings.

Figure 1:
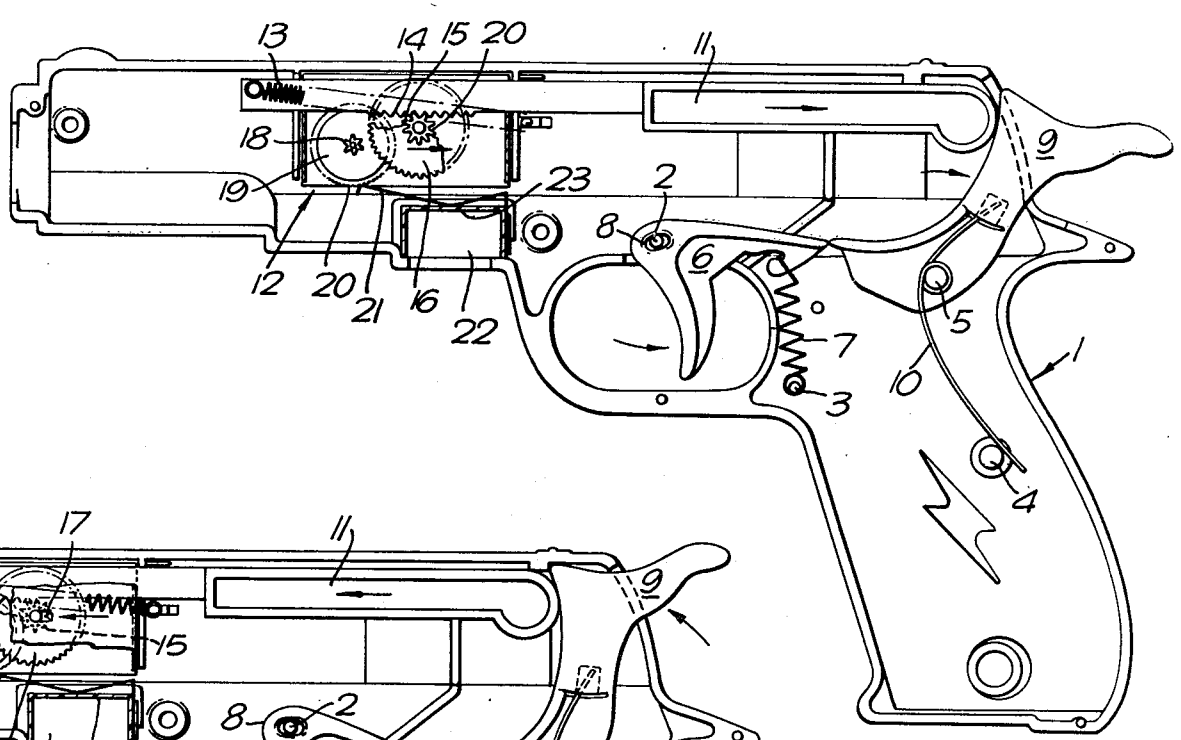
FIG. 1 is a side elevation of a toy gun with part of the housing removed to reveal the interior parts, the trigger being partially drawn.
Figure 2:
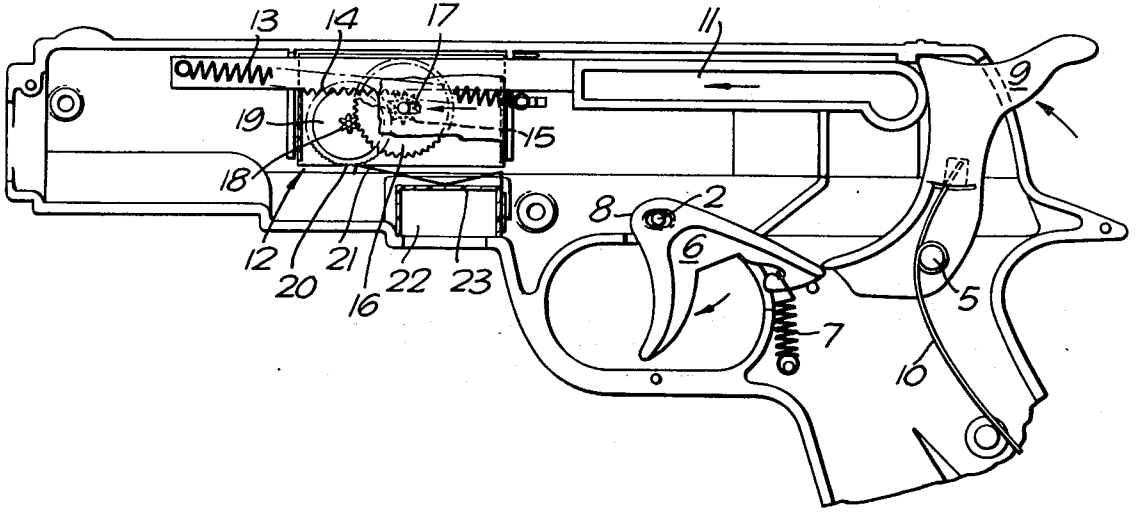
FIG. 2 is a similar view after the gun has been fired.

The toy gun is made up from two plastics moulded housing halves of which one is shown. These halves which are screwed, glued, welded or otherwise secured together are moulded with external features of barrel, trigger, guard, sights, catches, clips and so on. Moulded in the half 1 shown are mounting lugs 2, 3, 4 and 5 for purposes hereinafter explained.

On lug 2 is mounted a pivotable trigger member 6 resiliently urged forward by a return spring 7 attached to the trigger member and to lug 3. It will be noted that the mounting aperture 8 in the member 6 is elongate so as to permit of longitudinal movement of the trigger member 6 to recock the trigger.

Acted on by the trigger member 6 is a pivotable hammer member 9 resiliently urged in the anticlockwise direction by a strong spring 10 engaged over lug 5 and with the hammer member and also with lug 4. It will be seen that when the trigger is pulled the trigger member engages with the hammer member 9 and urges it in a clockwise direction against the force of spring 10 until toward the end of its travel the trigger member slips off the end of the hammer member which thereupon rapidly returns to its original position under spring action.

Associated with the hammer member 9 is a longitudinally movable slide member 11 mounted for sliding movement in sound-producing mechanism generally denoted by 12. A further spring 13 connected between the end of the slide member and the mechanism draws the slide member back, i.e. to the right, when the hammer member 9 is drawn back, and then when the hammer member is released it urges the slide member forward, i.e. to the left, at high speed.

The slide member is formed with a plurality of teeth 14 which engage a pinion 15 mounted on a cog 16 which is mounted in an elongate mounting aperture 17; thus as the slide member 11 is retracted the cog 16 moves to the right, out of engagement with pinion 18. When released to return however, the cog 16 moves to the left into engagement with pinion 18 which, since it is fixed to flywheel 19 causes the flywheel to rotate at high speed.

The outer cylindrical surface 20 of the flywheel is knurled to give a multiplicity of projections against which bears a spring member 21. The spring member is mounted at one edge of an open plastics box 22 whose base 23 forms a diaphragm against which the spring member 21 also bears. Thus, when the spring member is vibrated at high speed by the rotating flywheel, the sound thereby produced is amplified by the diaphragm and passes out through the open side of the box 22 to give a sound similar to that of a ricochet.

It will thus be seen that the invention has provided a toy gun with ricochet sound-producing means which can be relatively inexpensive to manufacture and reliable in construction.

I claim:

1. A toy gun having a simulated barrel and handle depending from one end thereof, a trigger pivotally supported beneath said barrel adjacent the handle and movable between forward and rearward positions, a spring connected to said handle and normally urging said trigger to its forward position, a hammer pivotally supported by said one end of said barrel and having an inner end engageable releasably by said trigger to actuate said hammer rearwardly, and a tensioning spring engaging said hammer and normally urging the same toward the forward end of said barrel, in combination with a sound-producing means mounted within said barrel and resembling the sound of a ricocheting bullet and means to actuate the same comprising an elongated slide supported within said barrel for longitudinal movement therein between and engageable with said hammer and sound-producing means, and a tension spring engaging said elongated slide and normally urging the same rearwardly, whereby when said trigger is pulled rearwardly it initially moves said hammer rearwardly against the tension of said hammer tensioning spring while said tension spring for said slide moves said slide rearwardly and said trigger subsequently disengages said hammer to release it for forward movement by said hammer tensioning spring and thereby moves said slide forwardly to actuate said sound-producing means.

2. The toy gun according to claim 1 in which said tension spring for said slide extends substantially parallel thereto and is arranged to move said slide rearwardly when said hammer is moved rearwardly by said trigger and thereby maintains the rear end of said slide in engagement with said hammer.

3. The toy gun according to claim 1 in which said sound-producing means includes a rotatable cog member having a pinion gear connected thereto and operable to interengage a vibratable noise-producing spring, and said slide having a series of teeth along one edge engageable with said gear and operable to rotate said rotatable member when said slide moves forwardly.

4. The toy gun according to claim 3 in which said sound-producing unit comprises in combination, a cog having a shaft and a smaller pinion connected thereto, slotted means supporting said shaft for limited fore and aft movement, a flywheel having a pinion gear connected thereto pivotally supported for engagement of said pinion gear thereon by said cog when said shaft of said cog is adjacent the forward end of said slot, and a vibratable spring supported within said barrel and engageable by said flywheel to vibrate the same and produce a noise resembling a ricocheting bullet.

5. The toy gun according to claim 4 in which said flywheel has a knurled surface engageable with one end of said spring to activate the same.

6. The toy gun according to claim 5 in which said barrel supports a diaphragm adjacent said spring and engageable thereby to effect said noise resembling a ricocheting bullet.

7. The toy gun according to claim 4 in which said slide is arranged during the initial part of its forward movement to move said cog forwardly in said slotted means to engage said pinion on said flywheel and subsequent forward movement of said slide actuates the pinion on said cog to rotate said cog and correspondingly rotate said flywheel to generate said noise by said spring.

* * * * *